US008459074B2

(12) United States Patent
Hofer et al.

(10) Patent No.: US 8,459,074 B2
(45) Date of Patent: Jun. 11, 2013

(54) ROLLING METHOD FOR A STRIP

(75) Inventors: Wolfgang Hofer, Erlangen (DE); Markus Martini, Hamm (DE)

(73) Assignee: Siemens Aktiengesellschaft, Munich (DE)

( * ) Notice: Subject to any disclaimer, the term of this patent is extended or adjusted under 35 U.S.C. 154(b) by 1013 days.

(21) Appl. No.: 12/519,405

(22) PCT Filed: Oct. 19, 2007

(86) PCT No.: PCT/EP2007/061197

§ 371 (c)(1),
(2), (4) Date: Jun. 16, 2009

(87) PCT Pub. No.: WO2008/074539

PCT Pub. Date: Jun. 26, 2008

(65) Prior Publication Data

US 2010/0031723 A1 Feb. 11, 2010

(30) Foreign Application Priority Data

Dec. 18, 2006 (DE) ..... 10 2006 059 709

(51) Int. Cl.

| | |
|---|---|
| ***B21B 37/58*** | (2006.01) |
| *B21B 37/72* | (2006.01) |
| *B21B 37/48* | (2006.01) |

(52) U.S. Cl.

USPC ..... 72/10.4; 72/8.8; 72/11.5; 72/11.4

(58) Field of Classification Search

USPC ..... 72/10.4, 10.7, 11.4, 11.5, 12.3, 12.5, 72/16.6, 16.7, 18.4, 18.5, 19.2, 19.4, 7.5, 72/8.6–8.8; 700/146, 148, 150, 152

See application file for complete search history.

(56) References Cited

U.S. PATENT DOCUMENTS 5,404,738 A * 4/1995 Sekiguchi ..... 72/11.4
5,448,901 A * 9/1995 Yu et al. ..... 72/7.2

(Continued)

FOREIGN PATENT DOCUMENTS

DE 19730262 10/1998
DE 102004043790 3/2006

(Continued)

OTHER PUBLICATIONS

International Search Report, PCT/EP2007/061197, 10 pages (Continued)

*Primary Examiner* — Dana Ross
*Assistant Examiner* — Pradeep C Battula
(74) *Attorney, Agent, or Firm* — King & Spalding L.L.P.

(57) ABSTRACT

A strip has a strip head and a strip leg. It is rolled, beginning at the strip head, in a roll stand of a rolling device between an upper and a lower roller arrangement of the roll stand. It is monitored whether the strip foot reaches a switching point located, viewed in the rolling direction, in front of the roll stand. From the time the strip leg reaches the switching point, the roller arrangements are subjected to a bending force expanding the roller arrangements by means of an adjusting device, the force being at least as high as a minimal force. The minimal force is at least as high as a balancing force of the upper roller arrangement. The minimal force is determined as a function of the parameters of the strip and/or the operating parameters of the rolling device.

9 Claims, 2 Drawing Sheets

U.S. PATENT DOCUMENTS

| | | | | |
|---|---|---|---|---|
| 5,906,129 | A | 5/1999 | Quambusch | |
| 7,031,797 | B2 * | 4/2006 | Reinschke et al. | 700/150 |
| 8,307,678 | B2 * | 11/2012 | Tachibana | 72/10.7 |

FOREIGN PATENT DOCUMENTS

| | | | |
|---|---|---|---|
| JP | 59061512 | A | 4/1984 |
| JP | 7144211 | A | 6/1995 |
| JP | 11267728 | A | 10/1999 |
| SU | 188451 | | 12/1966 |
| SU | 698691 | A | 12/1979 |
| SU | 910261 | B | 3/1982 |
| SU | 1258543 | A | 9/1986 |

OTHER PUBLICATIONS

German Office Action, German Application No. 10 2006 059 709.5-55, 5 pages.

Konovalov, U.A., Handbook of Mill Workers, Moscow, Verlag, "Metallurgy", Book, p. 42, 1977.

"The Technical Dictionary of Metallurgy", Book, p. 273, 1989.

* cited by examiner

ROLLING METHOD FOR A STRIP

CROSS-REFERENCE TO RELATED APPLICATIONS

This application is a U.S. National Stage Application of International Application No. PCT/EP2007/061197 filed Oct. 19, 2007, which designates the United States of America, and claims priority to German Application No. 10 2006 059 709.5 filed Dec. 18, 2006, the contents of which are hereby incorporated by reference in their entirety.

TECHNICAL FIELD

The present invention relates to a rolling method for a strip which comprises a head of the strip and a tail of the strip, wherein the strip is rolled, beginning with the head of the strip, in a rolling stand of a rolling device between an upper and a lower arrangement of rolls of the rolling stand.

The present invention also relates to a computer program which comprises machine code, the execution of which by a control device for a rolling stand has the effect that the rolling stand is operated according to such a rolling method.

Furthermore, the present invention relates to a data carrier on which such a computer program is stored.

The present invention also relates to a control device for a rolling stand in which such a computer program is stored, wherein the computer program can be executed by the control device.

Finally, the present invention relates to a rolling device for rolling a strip, which device comprises at least one rolling stand with an upper and a lower arrangement of rolls and a setting device for subjecting the arrangements of rolls to a bending force, wherein the rolling stand is controlled by means of a control device of the type described above.

BACKGROUND

The items described above are generally known. In particular, every conventional rolling operation takes place in the way described above, control units for rolling stands are software-programmed and every conventional rolling device is formed in the way described above.

In the production of metal strip, in particular hot strip, there can be the problem that the tail of the strip breaks out laterally in a rolling mill. Therefore, there can be the problem that the actually desired, central path of the strip is not ensured, and unproblematic operation of the rolling device in terms of the rolling operation is not ensured.

The lateral breaking out of the strip in a horizontal direction may be caused by various physical dependences. Examples of such dependences are an unsymmetrical tensile stress profile over the width of the strip, a wedge-shaped strip cross section, a skewed position of the work rolls, an unsymmetrical form of the work rolls, etc.

In order to avoid the lateral breaking out of the strip and the concomitant disadvantages, it is known in the prior art to lower the tension in the strip on the inlet side of the rolling stands to zero. The lowering of the tension may take place, for example, by lowering a loop lifter, which is arranged between the rolling stand and a further rolling stand arranged upstream. Alternatively, the roll gap of the upstream rolling stand may also be fully or partially opened. This procedure has the disadvantage that it has a direct influence on the rolling operation as such. In particular, reducing the tension leads to stronger rolling of the strip in the rolling stand. Opening the upstream rolling stand even has the consequence of entirely or partly precluding the rolling operation that can actually be brought about in this upstream rolling stand.

A further measure taken in the prior art is to arrange segmented tension measuring rollers, that is to say loop lifters by means of which the tensile stress over the width of the strip can be sensed, ahead of or behind the rolling stand. The sensed tensile stresses can in this case serve as a basis for a closed-loop control, which counteracts the lateral breaking out of the strip. However, segmented tension measuring rollers are very expensive. Furthermore, the effectiveness of this measure has not been empirically substantiated.

JP 11 267 728 A discloses a rolling method of the type mentioned at the beginning in which it is monitored whether the tail of the strip reaches a changeover point lying ahead of the rolling stand, as seen in the rolling direction, and, as from the point in time at which the tail of the strip reaches the changeover point (changeover time), the arrangements of rolls are subjected by means of a setting device to a bending force which spreads the arrangements of rolls apart and is as great as a balancing force of the upper arrangement of rolls. The balancing force of the upper arrangement of rolls is the gravitational force that has to be compensated to keep the upper arrangement of rolls in balance, that is to say to prevent the upper arrangement of rolls from sinking onto the lower arrangement of rolls.

JP 07 144 211 A discloses a rolling method in which the operating mode of the rolling device is changed over at a point in time at which the tail of the strip passes a measuring arrangement which is arranged between the rolling stand and a holding-up element for the strip situated upstream of the rolling stand, as seen in the rolling direction.

SUMMARY

According to various embodiments, a rolling method and the items corresponding thereto (computer program, data carrier, control device, rolling device) can be provided by means of which lateral breaking out of the strip can be optimally counteracted without adversely influencing the rolling operation.

According to an embodiment, a rolling method for a strip, which comprises a head of the strip and a tail of the strip, may comprising the steps of:—rolling the strip, beginning with the head of the strip, in a rolling stand of a rolling device between an upper and a lower arrangement of rolls of the rolling stand,—monitoring whether the tail of the strip reaches a changeover point lying ahead of the rolling stand, as seen in the rolling direction,—as from the time at which the tail of the strip reaches the changeover point, subjecting the arrangements of rolls by means of a setting device to a bending force, which spreads the arrangements of rolls apart and is at least as great as a minimal force, wherein the minimal force is at least as great as a balancing force of the upper pair of rolls, and wherein the minimal force is determined in dependence on at least one of parameters of the strip and operating parameters of the rolling device.

According to a further embodiment, the strip can be clamped between the rolling stand and a holding-up element situated upstream, as seen in the rolling direction. According to a further embodiment, the changeover point may lie between the rolling stand and the holding-up element, as seen in the rolling direction. According to a further embodiment, the changeover point may lie ahead of the holding-up element, as seen in the rolling direction. According to a further embodiment, it can be checked whether, at the changeover time, the arrangements of rolls have already been subjected by means of the setting device to a bending force which spreads the arrangements of rolls apart and is at least as great as the minimal force, and in that, if so, this bending force is maintained and, if not, the bending force is raised to the minimal force. According to a further embodiment, the changeover point can be determined in dependence on at least one of parameters of the strip and operating parameters of the rolling device. According to a further embodiment, the setting device may comprise a setting subdevice on the drive side and a setting subdevice on the operator side, wherein, during the rolling of the strip, a functional profile of at least one of parameters of the strip and operating parameters of the rolling device is recorded transversely in relation to the rolling direction and wherein, in dependence on the recorded functional profile, a division of the bending force between the setting subdevice on the drive side and the setting subdevice on the operator side is determined.

According to another embodiment, a computer program, which comprises machine code, the execution of which by a control device for a rolling stand has the effect that the rolling stand is operated according to a rolling method as described above.

According to yet another embodiment, a data carrier may store a computer program as described above in a machine-readable form.

According to yet another embodiment, a control device for a rolling stand may store a computer program as described above that can be executed by the control device.

According to yet another embodiment, a rolling device for rolling a strip, which device comprises at least one rolling stand with an upper and a lower arrangement of rolls and a setting device for subjecting the arrangements of rolls to a bending force, wherein the rolling stand is controlled by means of a control device as described above.

BRIEF DESCRIPTION OF THE DRAWINGS

Further advantages and details emerge from the following description of exemplary embodiments in conjunction with the drawings showing the basic principles, in which.

DETAILED DESCRIPTION

Figure 1:
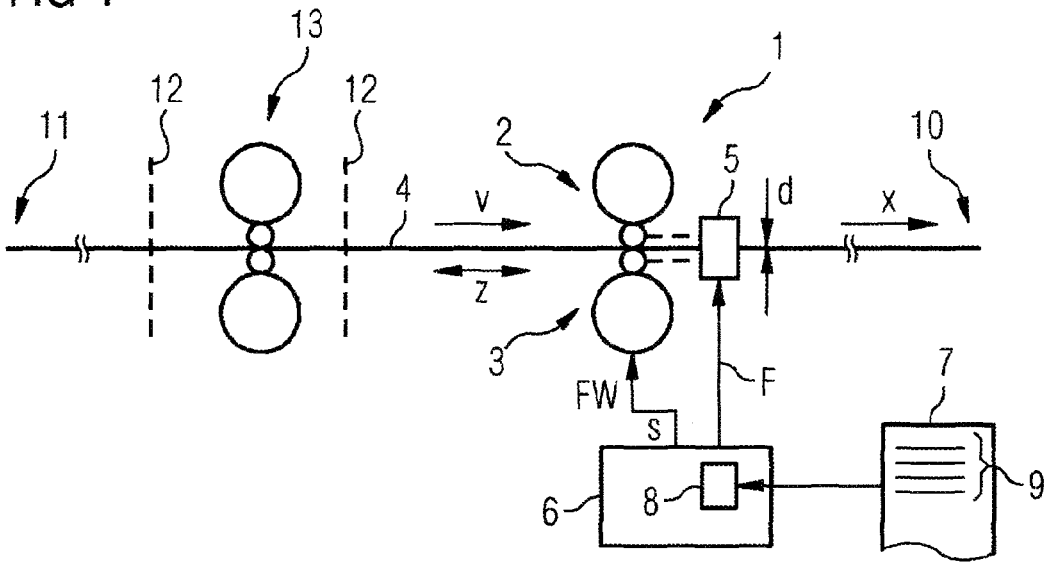
FIG. 1 shows a rolling device from the side.

According to various embodiments, the arrangement of rolls can be subjected as from a changeover time to a bending force which spreads the arrangement of rolls apart and is at least as great as a minimal force. The minimal force is in this case at least as great as the balancing force of the upper arrangement of rolls. It is determined according to various embodiments in dependence on parameters of the strip and/or operating parameters of the rolling device.

Corresponding hereto, the object is achieved in technical programming terms by a computer program which comprises machine code, the execution of which by a control device for a rolling stand has the effect that the rolling stand is operated according to such a rolling method.

The object is also achieved by a data carrier, on which such a computer program is stored in a machine-readable form.

In technical terms of devices, the object is achieved by a control device for a rolling stand in which such a computer program that can be executed by the control device is stored. Finally, the object is also achieved in technical terms of devices by a rolling device of the type mentioned at the beginning in which the rolling stand is controlled by means of a control device of the type last described.

In the case of most rolling operations, the strip is clamped between the rolling stand and a holding-up element situated upstream, as seen in the rolling direction. The holding-up element may for its part likewise be a rolling stand.

The changeover point lies ahead of the rolling stand, as seen in the rolling direction. Depending on the configuration of an embodiment, the changeover point may lie between the rolling stand and the holding-up element or ahead of the holding-up element, as seen in the rolling direction.

It is possible that it is checked whether, at the changeover time, the arrangements of rolls have already been subjected by means of the setting device to a bending force which spreads the arrangements of rolls apart and is at least as great as the minimal force. If so, this bending force may be maintained. If not, the bending force is raised to the minimal force. This procedure has the advantage that the rolling operation can be continued unchanged if the bending force is already great enough. Only if the bending force is not great enough is it raised to the minimal force.

It is possible that the changeover point is pre-set. Preferably, however, the changeover point is determined in dependence on parameters of the strip and/or operating parameters of the rolling device.

The setting device generally comprises a setting subdevice on the drive side and a setting subdevice on the operator side. Generally, the setting subdevices on the drive side and on the operator side are activated symmetrically. In individual cases, however, it may be of advantage if, during the rolling of the strip, a functional profile of parameters of the strip and/or operating parameters of the rolling device is recorded transversely in relation to the rolling direction and, in dependence on the recorded functional profile, a division of the bending force between the setting subdevice on the drive side and the setting subdevice on the operator side is determined. In this case, an unsymmetrical distribution of the bending force between the two setting subdevices may be obtained.

Figure 2:
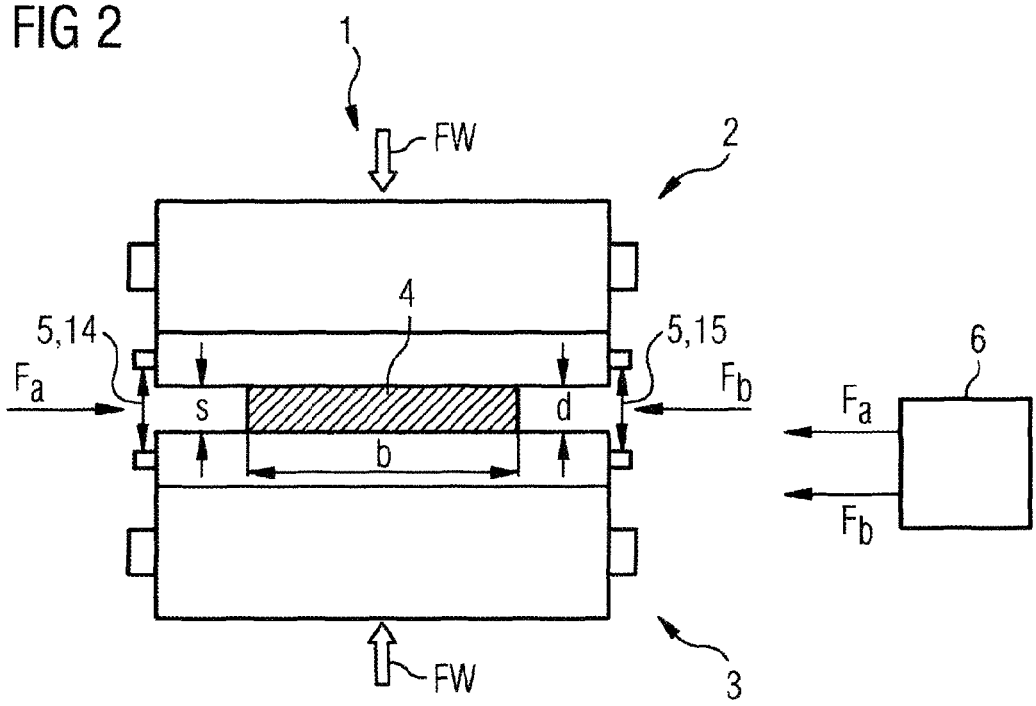
FIG. 2 shows a section through a rolling stand along a line II-II in FIG. 1

According to FIGS. 1 and 2, a rolling device comprises at least one rolling stand 1. The rolling stand 1 comprises an upper arrangement of rolls 2 and a lower arrangement of rolls 3. A strip 4 is rolled between the arrangements of rolls 2, 3.

The rolling standing 1 also comprises a setting device 5. The setting device 5 acts on work rolls of the arrangements of rolls 2, 3. By means of the setting device 5, the arrangements of rolls 2, 3 can be subjected to a bending force F. Depending on the algebraic sign of the bending force F, the setting device 5 spreads the arrangements of rolls 2, 3 apart or presses them together.

The rolling device also comprises a control device 6. The control device 6 serves for controlling the rolling stand 1. The control device 6 is fed a computer program 7, which is stored in a data carrier 8 of the control device 6. The data carrier 8 of the control device 6 corresponds to a data carrier in the sense of the present invention.

The computer program 7 comprises machine code 9, which can be executed by the control device 6. When the control device 6 executes the computer program 7, it operates the rolling stand 1 according to a rolling method that is explained in more detail below in conjunction with FIG. 3.

Figure 3:
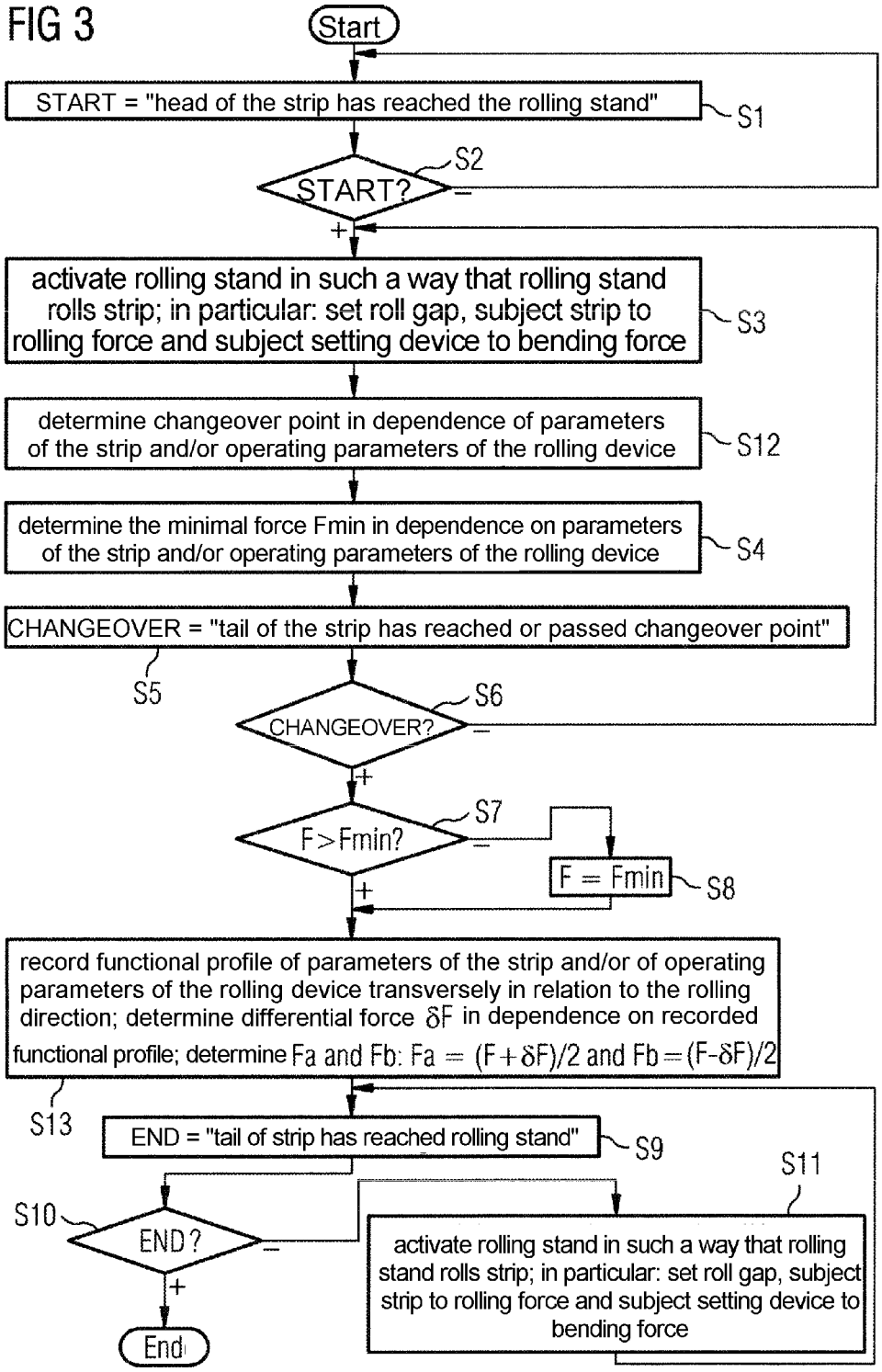
FIG. 3 shows a flow diagram.

According to FIG. 3, the control device 6 first determines in a step S1 the value of a first logical variable START. The first logical variable START assumes the value "TRUE" when and only when a head 10 of the strip 4 has reached the rolling stand 1.

In a step S2, the control device 6 checks the value of the first logical variable START. Depending on the result of the check, the control device 6 goes back to step S1 or proceeds to a step S3.

In step S3, the control device 6 activates the rolling stand 1 in such a way that the rolling stand 1 rolls the strip 4. The activation of the rolling stand 1 by the control device 6 has the effect in particular that a roll gap s is set and the strip 4 is subjected to a rolling force FW. Furthermore, the activation of the rolling stand 1 by the control device 6 has the effect that the setting device 5 is subjected to the bending force F. The value of the bending force F is determined by the control device 6 in accordance with the technological requirements of the rolling operation. The value may be greater than or less than a minimal force Fmin and also greater than or less than the balancing force of the upper arrangement of rolls 2. It may also be negative (i.e. the arrangements of rolls 2, 3 are pressed together).

In a step S4, the control device 66 determines the minimal force Fmin. The determination of the minimal force Fmin takes place in dependence on parameters of the strip 4 and/or operating parameters of the rolling device. Examples of parameters of the strip 4 are its material properties, its dimensions and its temperature. Examples of operating parameters of the rolling device are a rolling speed v, a pass reduction, a tension Z (optionally as a function over the strip width b) etc. The minimal force Fmin is determined in step S4 in such a way that it is at least as great as the balancing force of the upper arrangement of rolls 2.

In a step S5, the control device 6 determines the value of a second logical variable CHANGEOVER. The second logical variable CHANGEOVER assumes the value "TRUE" when and only when a tail 11 of the strip 4 has reached or passed a changeover point.

As can be seen in particular from FIG. 1, the strip 4 is generally clamped between the rolling stand 1 and a holding-up element 13 situated upstream, as seen in the rolling direction x. The holding-up element 13 may, in particular, itself be a rolling stand. The changeover point 12 may lie—see FIG. 1 once again—between the rolling stand 1 and the holding-up element 13, as seen in the rolling direction x. Alternatively, however, it is also possible that the changeover point 12 lies ahead of the holding-up element 13, as seen in the rolling direction x. By way of example, a possible changeover point 12 is illustrated in FIG. 1 by dashed lines for each of these two cases.

In a step S6, the control device 6 checks the value of the second logical variable CHANGEOVER. Depending on the result of the check, the control device 6 goes back to step S3 or proceeds to a step S7.

In step S7, the control device and 6 checks whether the bending force F determined in step S3 is greater than the minimal force Fmin. If this is not the case, in a step S8 the control device 6 raises the bending force F to the minimal force Fmin. Otherwise, no measures have to be taken. In this case, the bending force F can be maintained.

In a step S9, the control device 6 determines the value of a third logical variable END. The third logical variable END assumes the value "TRUE" when and only when the tail 11 of the strip reaches the rolling stand 1.

In a step S10, the control device 6 checks the value of the third logical variable END. Depending on the result of the check, the control device 6 goes over to a step S11 or brings the method to an end.

The step S11 corresponds substantially in content to the step S3. As a difference from step S3, however, in step S11 the bending force F is no longer determined but is only maintained. From step S11, the control device 6 goes back to step S9. According to the exemplary embodiment of FIG. 3, the bending force F is only raised to the minimal force Fmin if the bending force F is less than the minimal force Fmin. Otherwise, the bending force F is maintained. Alternatively, it would be possible always to set the bending force F to the minimal force Fmin, that is to say to omit step S7 and always carry out step S8. However, the procedure of FIG. 3 is to be preferred.

In conjunction with FIG. 3, two variants of the procedure of FIG. 3 are explained below. In FIG. 3, the two variants are shown combined with each other. They are, however, independent of each other. They can therefore be realized individually.

According to FIG. 3, inserted between steps S3 and S4 is a step S12. Instead of S12, the control device 6 determines the changeover point 12. The determination of the changeover point 12 takes place within step S12 in dependence on parameters of the strip 4 and/or operating parameters of the rolling device. The parameters of the strip 4 and the operating parameters of the rolling device may be the same, those mentioned above in conjunction with the determination of the minimal force Fmin. Step S12 realizes the first variant of the procedure from FIG. 3.

According to FIG. 3, step S12 precedes step S4. However, it could alternatively follow step S4.

According to FIG. 3, step S9 is also preceded by a step S13. In step S13, the control device 6 records a functional profile of parameters of the strip 4 and/or of operating parameters of the rolling device transversely in relation to the rolling direction x. In dependence on the recorded functional profile—in particular in dependence on the tensile stress Z and the rolling force FW—the control device 6 determines within step S14 a differential force δF. A setting subdevice 14 on the drive side and a setting subdevice 15 on the operator side of the setting device 5 are subjected to a bending force Fa on the drive side and a bending force Fb on the operator side, wherein the relationships $$Fa+Fb=F \text{ and}$$

$$Fa-Fb=\delta F$$

apply. As a result, a division of the bending force F between the setting subdevice 14 on the drive side and the setting subdevice 15 on the operator side is consequently determined within step S13.

By means of the present invention it is possible in particular to achieve the effect that an increased strip reduction at the edges of the strip can be avoided, and consequently a different material flow at the two edges of the rolled strip can be prevented. A further advantage is that the rolling operation as such remains uninfluenced. In particular, the thickness d of the strip 4 running out from the rolling stand 1 remains uninfluenced. This has the result in particular of higher productivity. Furthermore, mechanical surface damage to the work rolls and to the surface of the strip can be reduced. The wearing of the work rolls can also be reduced. This also has the result of increasing the productivity of the rolling device.

The above description serves exclusively for explaining the present invention. On the other hand, the scope of protection of the present invention is to be determined exclusively by the appended claims.

The invention claimed is:

1. A rolling method for a strip, which comprises a head of the strip and a tail of the strip, the method comprising the steps of:

rolling the strip, beginning with the head of the strip, in a rolling stand of a rolling device between an upper arrangement of rolls and a lower arrangement of rolls of the rolling stand, monitoring whether the tail of the strip reaches a changeover point lying upstream of the rolling stand, as seen in the rolling direction, upon tail of the strip reaching the changeover point:

determining whether the arrangements of rolls are subjected by a setting device to a bending force that spreads the arrangements of rolls apart and is at least as great as a minimal force, in response to determining that the bending force is below the minimal force, automatically increasing the bending force to the minimal force, and from the time at which the tail of the strip reaches the changeover point, using a setting device to maintain the bending force on the arrangements of rolls at a level at least as great as the minimal force, wherein the minimal force is at least as great as a balancing force of the upper arrangement of rolls, and wherein the minimal force is determined in dependence on at least one of parameters of the strip and operating parameters of the rolling device.

2. The rolling method according to claim 1, wherein the strip is clamped between the rolling stand and a holding-up element situated upstream, as seen in the rolling direction.

3. The rolling method according to claim 2, wherein the changeover point lies upstream of the holding-up element, as seen in the rolling direction.

4. The rolling method according to claim 1, wherein the changeover point lies between the rolling stand and the holding-up element, as seen in the rolling direction.

5. The rolling method according to claim 1, wherein the changeover point is determined in dependence on at least one of parameters of the strip and operating parameters of the rolling device.

6. The rolling method according to claim 1, wherein the setting device comprises a setting subdevice on the drive side and a setting subdevice on the operator side, wherein, during the rolling of the strip, a functional profile of at least one of parameters of the strip and operating parameters of the rolling device is recorded transversely in relation to the rolling direction and wherein, in dependence on the recorded functional profile, a division of the bending force between the setting subdevice on the drive side and the setting subdevice on the operator side is determined.

7. A rolling method for a strip, which comprises a head of the strip and a tail of the strip, the method comprising the steps of:

rolling the strip, beginning with the head of the strip, in a rolling stand of a rolling device between an upper arrangement of rolls and a lower arrangement of rolls of the rolling stand, monitoring whether the tail of the strip reaches a changeover point lying upstream of the rolling stand, as seen in the rolling direction, determining a minimal force that is at least as great as a balancing force of the upper arrangement of rolls, from the time at which the tail of the strip reaches the changeover point, using a setting device to subject the arrangements of rolls to a bending force that spreads the arrangements of rolls apart and is at least as great as the minimal force, including:

recording a functional profile of at least one parameter of the strip or the rolling device transverse to the rolling direction, based on the recorded functional profile, determining a division of the bending force between (a) a setting subdevice on a drive side of the setting device and (b) a setting subdevice on an operator side of the setting device, and applying the bending force to the arrangements of rolls using according to the determined division between the setting subdevice on the drive side and the setting subdevice on the operator side.

8. A rolling device for rolling a strip, comprising:

at least one rolling stand with an upper arrangement of rolls and a lower arrangement of rolls, a setting device for subjecting the arrangements of rolls to a bending force, and a control system configured to:

roll the strip, beginning with a head of the strip, in the rolling stand between the upper and lower arrangements of rolls, monitor whether a tail of the strip reaches a changeover point lying upstream of the rolling stand, as seen in the rolling direction, upon tail of the strip reaching the changeover point:

determine whether the arrangements of rolls are subjected by a setting device to a bending force that spreads the arrangements of rolls apart and is at least as great as a minimal force, the minimal force being determined based on at least one of parameters of the strip and operating parameters of the rolling device, and being at least as great as a balancing force of the upper arrangement of rolls, in response to determining that the bending force is below the minimal force, increase the bending force to the minimal force, and from the time at which the tail of the strip reaches the changeover point, control the setting device to maintain the bending force on the arrangements of rolls at a level at least as great as a the minimal force.

9. A rolling device for rolling a strip, comprising:

at least one rolling stand with an upper arrangement of rolls and a lower arrangement of rolls, a setting device for subjecting the arrangements of rolls to a bending force, the setting device including a setting subdevice on a drive side of the setting device and a setting subdevice on an operator side of the setting device, and a control system configured to:

roll the strip, beginning with the head of the strip, in a rolling stand of a rolling device between an upper arrangement of rolls and a lower arrangement of rolls of the rolling stand, monitor whether the tail of the strip reaches a changeover point lying upstream of the rolling stand, as seen in the rolling direction, determine a minimal force that is at least as great as a balancing force of the upper arrangement of rolls, from the time at which the tail of the strip reaches the changeover point, control the setting device to subject the arrangements of rolls to a bending force that spreads the arrangements of rolls apart and is at least as great as the minimal force, including:

recording a functional profile of at least one parameter of the strip or the rolling device transverse to the rolling direction, based on the recorded functional profile, determining a division of the bending force between the setting subdevice on the drive side and the setting subdevice on the operator side, and applying the bending force to the arrangements of rolls using according to the determined division between the setting subdevice on the drive side and the setting subdevice on the operator side.

* * * * *